US008982167B2

(12) United States Patent
Malka et al.

(10) Patent No.: US 8,982,167 B2
(45) Date of Patent: Mar. 17, 2015

(54) SUB-PIXEL RENDERING OF A MULTIPRIMARY IMAGE

(71) Applicant: Genoa Color Technologies Ltd., Hod Hasharon (IL)

(72) Inventors: Doron Malka, Tel-Aviv (IL); Moshe Ben-Chorin, Rehovot (IL)

(73) Assignee: Samsung Display Co., Ltd., Yongin (KR)

( * ) Notice: Subject to any disclaimer, the term of this patent is extended or adjusted under 35 U.S.C. 154(b) by 0 days.

(21) Appl. No.: 14/083,306

(22) Filed: Nov. 18, 2013

(65) Prior Publication Data

US 2014/0078169 A1 Mar. 20, 2014

Related U.S. Application Data

(62) Division of application No. 12/095,004, filed as application No. PCT/IL2006/001368 on Nov. 28, 2006, now Pat. No. 8,587,621.

(60) Provisional application No. 60/739,935, filed on Nov. 28, 2005.

(51) Int. Cl.
*G09G 5/02* (2006.01)
*G09G 3/36* (2006.01)

(52) U.S. Cl.
CPC ..... *G09G 3/3607* (2013.01); *G09G 2340/0457* (2013.01); *G09G 2340/06* (2013.01)
USPC ..... 345/694; 345/88

(58) Field of Classification Search
None
See application file for complete search history.

(56) References Cited

U.S. PATENT DOCUMENTS

| | | | | |
|---|---|---|---|---|
| 4,862,388 | A * | 8/1989 | Bunker | 345/427 |
| 5,673,376 | A * | 9/1997 | Ray et al. | 345/427 |
| 6,128,000 | A * | 10/2000 | Jouppi et al. | 345/614 |
| 6,185,003 | B1 * | 2/2001 | Oyen | 358/1.9 |
| 6,452,595 | B1 * | 9/2002 | Montrym et al. | 345/426 |
| 6,714,206 | B1 * | 3/2004 | Martin et al. | 345/589 |
| 6,947,058 | B1 * | 9/2005 | Elmquist | 345/611 |
| 6,954,216 | B1 * | 10/2005 | Dowling et al. | 345/593 |
| 2002/0008714 | A1 * | 1/2002 | Tezuka et al. | 345/694 |
| 2003/0034992 | A1 * | 2/2003 | Brown et al. | 345/690 |
| 2003/0117409 | A1 * | 6/2003 | Lefebvre et al. | 345/581 |
| 2003/0210409 | A1 * | 11/2003 | Huang et al. | 358/1.1 |
| 2004/0061877 | A1 * | 4/2004 | Bhattacharjya | 358/1.8 |
| 2004/0174389 | A1 * | 9/2004 | Ben-David et al. | 345/694 |
| 2004/0246389 | A1 * | 12/2004 | Roth | 349/5 |
| 2005/0056768 | A1 * | 3/2005 | Oldham et al. | 250/208.1 |
| 2005/0134785 | A1 * | 6/2005 | Roth et al. | 349/144 |
| 2006/0001688 | A1 * | 1/2006 | Chabreck et al. | 347/19 |
| 2006/0061590 | A1 * | 3/2006 | Akenine-Moller et al. | 345/611 |
| 2006/0132511 | A1 * | 6/2006 | Feng | 345/694 |
| 2006/0221026 | A1 * | 10/2006 | Roth et al. | 345/88 |
| 2007/0008336 | A1 * | 1/2007 | Bastos et al. | 345/613 |
| 2007/0176948 | A1 * | 8/2007 | Ben-David et al. | 345/690 |
| 2007/0210987 | A1 * | 9/2007 | Hashimoto et al. | 345/60 |
| 2008/0316235 | A1 * | 12/2008 | Okazaki et al. | 345/694 |

* cited by examiner

*Primary Examiner* — Antonio Xavier
(74) *Attorney, Agent, or Firm* — Pearl Cohen Zedek Latzer Baratz LLP

(57) ABSTRACT

Methods and systems for displaying an image on a display, for example, a liquid crystal display (LCD) having more than three different colored filters. The display may include a plurality of sub-pixels, each of the sub-pixels being aligned with a filter having a color selected from a set of more than three different colors, none of which is white. A number of methods and systems for processing data for display are disclosed, for example, using data points from adjacent pixel groups, or data points for different colors within the same pixel data set.

6 Claims, 3 Drawing Sheets

SUB-PIXEL RENDERING OF A MULTIPRIMARY IMAGE

CROSS REFERENCE TO RELATED APPLICATIONS

This application is a divisional application of U.S. patent application Ser. No. 12/095,004, filed Dec. 23, 2008, which is a National Phase application of PCT International Application No. PCT/IL2006/001368, International Filing Date Nov. 28, 2006, which in turn claims the benefit of U.S. Provisional Patent Application No. 60/739,935, filed Nov. 28, 2005, all of which are incorporated herein by reference in their entirety.

FIELD OF THE INVENTION

The invention relates generally to multi-primary color displays and, more particularly, to multi-primary Liquid Crystal Displays (LCDs).

BACKGROUND

FIG. 1 schematically illustrates a conventional color Liquid Crystal Display (LCD) system 100. System 100 may include an array 108 of liquid crystal (LC) elements (cells) 104, for example, an LC array using Thin Film Transistor (TFT) active-matrix technology, as is known in the art, and a tri-color filter array, e.g., a RGB filter array 106, which may be juxtaposed with LC array 108. System 100 may also include a first set of electronic circuits ("row drivers") 110 and a second set of electronic circuits ("column drivers") 130 for driving the LC array cells, e.g., by active-matrix addressing, as is known in the art. In existing LCD devices, each full-color pixel of the displayed image is reproduced by three sub-pixels, each sub-pixel corresponding to a different primary color, e.g., each pixel is reproduced by driving a respective set of R, G and B sub-pixels. For each sub-pixel there is a corresponding cell in LC array 108. The transmittance of each of the sub-pixels is controlled by the voltage applied to the corresponding LC cell, based on RGB data input 119 for the corresponding pixel. A timing controller (TCON) 118 receives the input RGB data and adjusts the magnitude of a signal 123 delivered to the different column drivers 130 based on the input data for each pixel. TCON 118 may also provide drivers 110 with a timing signal 121 to controllably activate rows of LC array 108, as is known in the art. The intensity of white light, e.g., provided by a back-illumination source, may be spatially modulated by LC array 108, selectively attenuating the light for each sub pixel according to the desired intensity of the sub-pixel. The selectively attenuated light passes through RGB color filter array 106, wherein each LC cell is in registry or in alignment with a corresponding color sub-pixel, producing the desired color sub-pixel combinations. The human vision system spatially integrates the light filtered through the different color sub-pixels to perceive a color image.

SUMMARY OF EMBODIMENTS OF THE INVENTION

Embodiments of the invention may provide for a method for displaying an image on a display having a plurality of sub-pixels, each of the sub-pixels being aligned with a filter having a color selected from a set of more than three different colors, none of which is white, comprising providing first and second pixel data sets, which pixel data sets each have more than three data points and correspond to first and second adjacent pixel groups respectively, the pixel groups including a plurality of sub-pixels, and for at least one sub-pixel in the first pixel group, calculating an intensity value based at least on a first data point included in the first pixel data set and corresponding to the color of the filter aligned with the sub-pixel, and a second data point, the second data point included in the second pixel data set.

Some embodiments of the invention may provide a method for displaying an image on a display having a plurality of sub-pixels, each of the sub-pixels being aligned with a filter having a color selected from a set of more than three different non-white colors, the method comprising providing a pixel data set having more than three data points and corresponding to a pixel group, and for at least one sub-pixel in the pixel group, providing an intensity value for the sub-pixel based at least on a data point in the data set corresponding to the color of the filter aligned with said sub-pixel and a second data point included in the data set corresponding to a color different from the color of the filter aligned with the sub-pixel. In some embodiments of the invention, the method may be practiced where each of the pixel groups includes fewer sub-pixels than the number of data points in the pixel data sets. The number of data points in the pixel data sets may correspond to the number of primary or fundamental colors in the display, which in varying embodiments may be, for example, four, five, six, or more colors. In some embodiments, the second point in the data set may correspond to a color that is not represented in the pixel group, for example, for which there is no filter aligned with any sub-pixels in the pixel group.

In some embodiments of the invention, the method may also include receiving first and second three-color data sets, each of said three-color data sets including exactly three data points and/or converting the first and second three-color data sets using a conversion algorithm to obtain said pixel data set, each of the second pixel data sets including more than three data points.

In some embodiments of the invention, the intensity value of the sub-pixel may be further based on yet a third data point, which corresponds to a color different than the color of the filter aligned with said sub-pixel. The third data point may be taken from the first data set, or from a data set corresponding to an adjacent pixel group.

The method may use a variety of weighting algorithms to calculate the various weights to give to the intensity value of the sub-pixel. A simple weighing may be calculated, or in some embodiments, a convolution algorithm for re-sampling a data set based on weights given to the different data points in different adjacent pixel groups may be used. Data points from any number of adjacent pixel groups may be used, for example, one pixel to one side of the pixel group being displayed, and two or three pixels to the other side of the pixel group being displayed. Data points in the additional data sets used for the calculation may correspond to the color of the sub-pixel being displayed, or may correspond to a different color.

The method may be used to calculate the intensity values of one or some or all sub-pixels in a pixel group. In some embodiments, the intensity value of at least one sub-pixel in a pixel group, for example, the sub-pixel at a center of the pixel group, may be calculated using solely the data point in the data set corresponding to the color of the filter aligned with the sub-pixel. The method may be used to calculate intensity values for some or all of the pixel groups in the display.

Some embodiments of the invention may provide a system comprising a display having a plurality of sub-pixels, each the sub-pixels aligned with a corresponding color filter, wherein the display includes filters having more than three different colors, none of said colors being white, a data converter to convert a first data set having exactly three data points to a second data set having more than three data points, wherein the second data set corresponds to a pixel group including a plurality of sub-pixels on said display, and a scaling processor to calculate for at least a portion of sub-pixels in each pixel group corresponding to the second data set an intensity value based at least on a data point in the second data set corresponding to the color of said sub-pixel and a data point in an additional data set. Some systems in accordance with embodiments of the invention may further include a timing controller to provide said intensity values to sub-pixels. In some systems in accordance with embodiments of the invention, the sub-pixels are liquid crystal elements. In some embodiments of the invention, the liquid crystal elements are controlled by thin film transistors. In some embodiments of the invention, the number of sub-pixels in each pixel group may be fewer than the number of different fundamental or primary colors in the display.

In some embodiments of the invention, the scaling processor may be to calculate the intensity value for the sub-pixel based at least on the data point in the additional data set, wherein the data point in the additional data set corresponds within the additional data set to the color of the filter aligned with the sub-pixel. In some embodiments, the scaling processor may be to calculate the intensity value based on a weighted average of the data point in the second data set and the data point in the additional data set. In some embodiments, the scaling processor may be to calculate for another portion of sub-pixels in the pixel group, for example, for one or more sub-pixels in the center of the pixel group, an intensity value based solely on a data point in said second data set corresponding to the color of said sub-pixel.

According to some embodiments of the invention, a system may be provided comprising a display having a plurality of sub-pixels, each of the sub-pixel aligned with a corresponding color filter, wherein the display includes filters having more than three different colors, none of the colors being white, a data converter to convert a first data set having exactly three data points to a second data set having more than three data points, wherein the second data set corresponds to a pixel group including a plurality of sub-pixels on the display, and a scaling processor to calculate for at least a portion of sub-pixels in each pixel group corresponding to the second data set an intensity value based at least on a data point in the second data set corresponding to the color of said sub-pixel and a second data point in the second data set corresponding to a color different than the color of said sub-pixel, wherein the different color is not among the filters aligned with any of the sub-pixels in the pixel group. In some embodiments of the invention, the number of sub-pixels in each pixel group may be fewer than the number of different colors in the display.

BRIEF DESCRIPTION OF THE DRAWINGS

The invention will be understood and appreciated more fully from the following detailed description of embodiments of the invention, taken in conjunction with the accompanying drawings of which.

Figure 1:
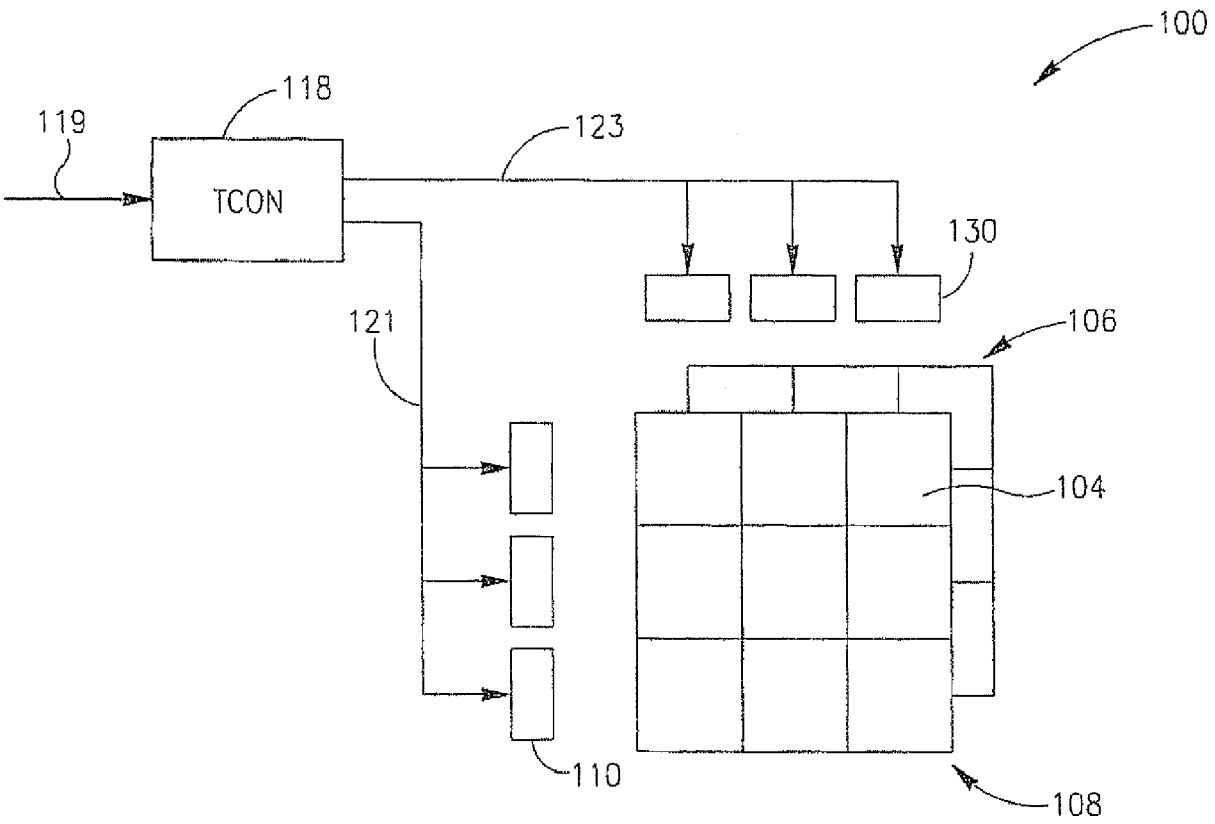
FIG. 1 PRIOR ART
FIG. 1 is a schematic block diagram of a conventional LCD color display system.

It will be appreciated that for simplicity and clarity of illustration, elements shown in the figures have not necessarily been drawn accurately or to scale. For example, the dimensions of some of the elements may be exaggerated relative to other elements for clarity or several physical components included in one element. Further, where considered appropriate, reference numerals may be repeated among the figures to indicate corresponding or analogous elements. It will be appreciated that these figures present examples of embodiments of the present invention and are not intended to limit the scope of the invention.

DETAILED DESCRIPTION OF SOME DEMONSTRATIVE EMBODIMENTS OF THE INVENTION

In the following description, various aspects of the present invention will be described. For purposes of explanation, specific configurations and details are set forth in order to provide a thorough understanding of the present invention. However, it will be apparent to one skilled in the art that the present invention may be practiced without the specific details presented herein. Furthermore, some features of the invention relying on principles and implementations known in the art may be omitted or simplified to avoid obscuring the present invention.

Unless specifically stated otherwise, as apparent from the following discussions, it is appreciated that throughout the specification discussions utilizing terms such as "processing", "computing", "calculating", "determining", or the like, refer to the action and/or processes of an electronic circuit or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices. In addition, the term "plurality" may be used throughout the specification to describe two or more components, devices, elements, parameters and the like.

Some embodiments of the invention may be implemented, for example, using a machine-readable medium or article which may store an instruction or a set of instructions that, if executed by a machine (for example, by a processor and/or by other suitable machines), cause the machine to perform a method and/or operations in accordance with embodiments of the invention. Such a machine may include, for example, any suitable processing platform, computing platform, computing device, processing device, computing system, processing system, computer, processor, Application Specific Integrated Circuit (ASIC), Field-Programmable Gate Array (FPGA), or the like, and may be implemented using any suitable combination of hardware and/or software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, various types of Digital Versatile Disks (DVDs), a tape, a cassette, or the like. The instructions may include any suitable type of code, for example, source code, compiled code, interpreted code, executable code, static code, dynamic code, or the like, and may be implemented using any suitable high-level, low-level, object-oriented, visual, compiled and/or interpreted programming language, e.g., C, C++, Java, BASIC, Pascal, Fortran, Cobol, assembly language, machine code, VHDL or the like.

Embodiments of the invention include a device, system and/or method of controllably activating drivers of an array of sub-pixel elements of n-primary colors, wherein n is greater than three.

According to some exemplary embodiments of the invention, the drivers may be controllably activated based on one or more display attributes and/or one or more image attributes, as described in detail below.

It will be appreciated that the term "display attributes" as used herein may refer to one or more attributes of a color display device, for example, a configuration of one or more sub-pixel elements within an array of sub-pixel elements of the display, a configuration of one or more defective sub-pixel elements within the array, a brightness and/or color non-homogeneity of the display device, and/or any other objective, subjective or relative attribute, which may be related to the display device.

It will be appreciated that the term "image attributes" as used herein may refer to one or more attributes related to at least part of a displayed color image, or a color image to be displayed, for example, a perceived bit-depth of pixels of at least part of the color image, a viewed smoothness of at least part of the color image, a brightness and/or color uniformity of at least part of the color image, a rendering scheme to be applied to at least part of the color image, and/or any other objective, subjective or relative attribute, which may be related to the color image.

Certain aspects of monitors and display devices with more than three primaries, in accordance with exemplary embodiments of the invention, are described in International Application PCT/IL02/00452, filed Jun. 11, 2002, entitled "DEVICE, SYSTEM AND METHOD FOR COLOR DISPLAY" and published 19 Dec. 2002 as PCT Publication WO 02/101644, and in International Application PCT/IL02/00307, filed Apr. 13, 2003, entitled "COLOR DISPLAY DEVICES AND METHODS WITH ENHANCED ATTRIBUTES" and published 23 Oct. 2003 as PCT Publication WO03/088203, the disclosure of which are incorporated herein by reference.

Some demonstrative embodiments of the invention may be implemented, for example, using a multi-primary (MP) display device having a Liquid Crystal display (LCD) panel, which may include, for example, an array of liquid crystal (LC) elements (cells), e.g., a LC array using Thin Film Transistor (TFT) active-matrix technology, as is known in the art. The panel may also include a controller to activate sub-pixels of the LC array according to a three-primary sub-pixel data configuration. For example, the LCD panel may include a standard backplane TFT for RGB LCD panel ("the standard RGB LCD").

According to some demonstrative embodiments of the invention, the device may also include an array of four or more MP sub-pixel filters juxtaposed with the LC array; and a sub-pixel processor to receive four-or-more primary image data and provide the controller with corresponding data in the three-primary sub-pixel configuration, e.g., as described in detail below.

According to some demonstrative embodiments of the invention, the above-described device may be manufactured at a relatively low cost, for example, by modifying a standard RGB LCD, e.g., instead of re-designing the TFT backplane of the LCD panel. For example, a standard RGB filter array of the standard LCD may be replaced by the array of four or more MP sub-pixel filters. According to an embodiment of the invention, a MP LCD display may include a plurality of sub-pixels having more than three different filters, for example, red, green, blue, and yellow. In an embodiment of the invention, a display may have filters colored red, green, blue, yellow and cyan. In an embodiment of the invention, a display may have filters colored red, green, blue, yellow, cyan and magenta. In exemplary embodiments of the invention, none of the filters is white. In conventional TFT backplanes, the aspect ratio of a sub-pixel is approximately 3:1, such that a group of sub-pixels of three different colors make up a pixel having aspect ratio of approximately 1:1. In exemplary embodiments of the invention, for example, where a standard RGB LCD is modified by replacing the RGB filters by an array of filters having more than three different colors, as described above, the aspect ratio of a group of sub-pixels including all of the more than three different colors may have an aspect ratio of 3:4 or 3:5 or 3:6, for four, five or six colors, respectively. Accordingly, the methods and systems described herein may compensate for such distortion.

Figure 2:
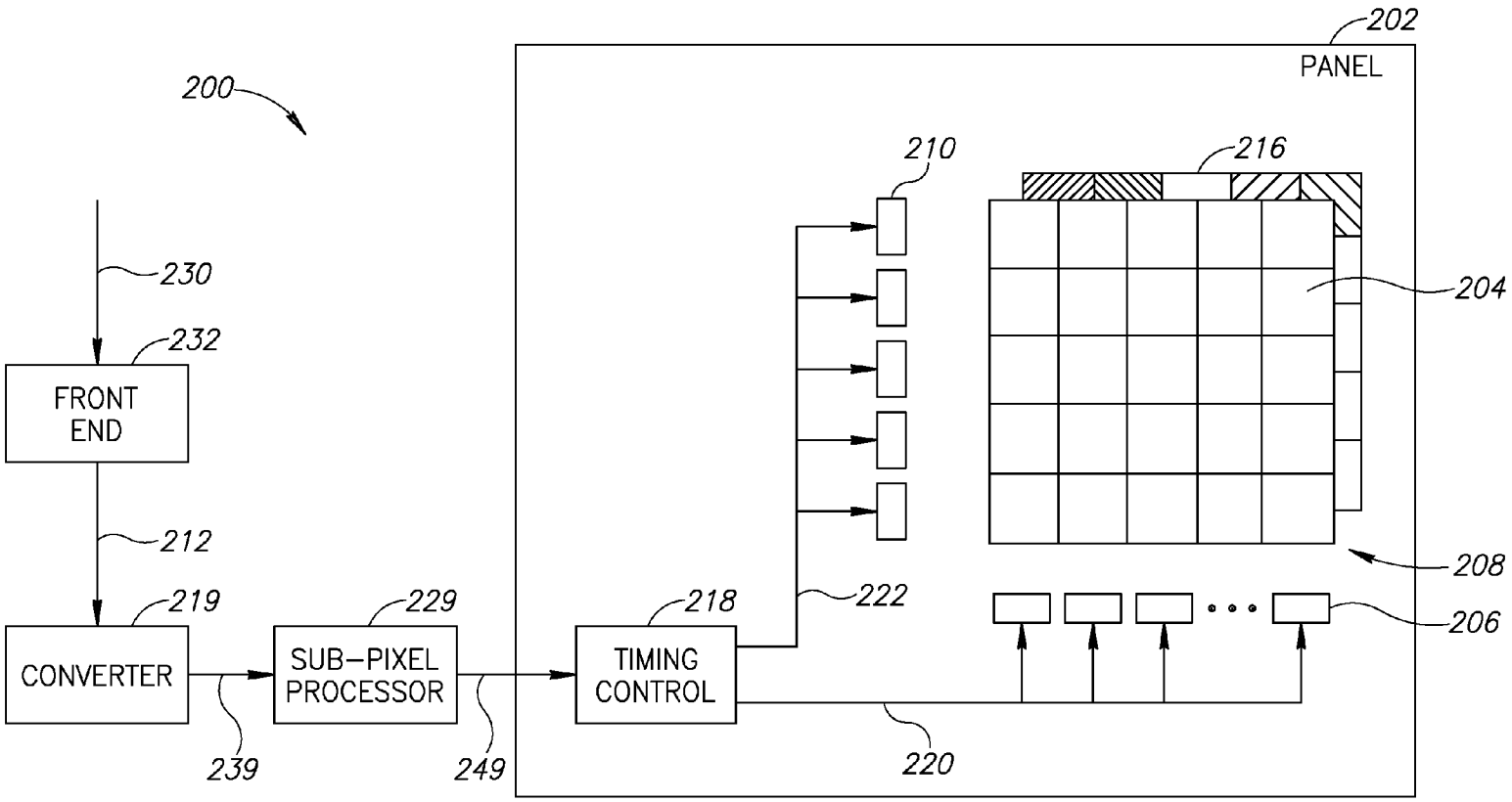
FIG. 2 is a schematic block diagram of a multi-primary color display system in accordance with exemplary embodiments of the invention.

Reference is made to FIG. 2, which schematically illustrates an n-primary color display system 200 to display a color image, e.g., based on a three-primary video input signal 212, in accordance with exemplary embodiments of the invention.

According to some demonstrative embodiments of the invention, system 200 may include a front-end module 232. Module 232 may include, for example, an analog-to-digital ("A/D") converter to convert an analog video input signal 230 into digital video input signal 212, as is known in the art. According to other exemplary embodiments signal 230 may include a digital video input signal and module 232 may not include the A/D converter.

Module 232 may optionally include a user interface (not shown), e.g., a keyboard, a mouse, a remote control and/or any type of user-interface as are known in the art. Module 232 may include any other software and/or hardware, e.g., as are known in the art.

According to some demonstrative embodiments of the invention, system 200 may also include a converter 219 to convert the image data of signals 212 into sub-pixel data signals 239 representing the image in terms of at least four primary colors.

Certain aspects of methods and devices for converting image data in three-primary video formats into a at-least-three-primary format, in accordance with exemplary embodiments of the invention, are described in International Application PCT/IL02/00410, filed May 23, 2002, entitled "DEVICE, SYSTEM AND METHOD OF DATA CONVERSION FOR WIDE GAMUT DISPLAYS" and published 12 Dec. 2002 as PCT Publication WO 02/099557, the disclosure of which is incorporated herein by reference.

According to some demonstrative embodiments of the invention system 200 may also include a sub-pixel processor 229, and a LCD panel 202, as are described in detail below.

Processor 229 may include any suitable processor, e.g., an ASIC, a FPGA, a Central Processing Unit (CPU), a Digital Signal Processor (DSP), a microprocessor, a host processor, a plurality of processors, a controller, a chip, a microchip, or any other suitable multi-purpose or specific processor or controller.

According to some demonstrative embodiments of the invention, processor 229 may generate signals 249 based on the MP sub-pixel data of signals 239. Processor 229 may generate signals 249 in a three-primary sub-pixel configuration, e.g., corresponding to a sub-pixel configuration of LCD panel 202, e.g., as described in detail below.

Some exemplary embodiments of the invention are described herein in relation to activating drivers of an array of LC elements, e.g., which may be part of a LCD panel. However, it will be appreciated by those skilled in the art, that other embodiments of the invention may be implemented for activating drivers of any other array of sub-pixel elements.

According to some demonstrative embodiments of the invention, panel 202 may include an array 208 of sub-pixel elements, e.g., LC elements (cells) 204, for example, an LC array using Thin Film Transistor (TFT) active-matrix technology, as is known in the art. For example, each of cells 204 may be connected to a horizontal ("row") line (not shown) and a vertical ("column") line (not shown), as are known in the art.

Panel 202 may also include a first set of electronic circuits 210 ("row drivers") associated with the row lines, and a second set of electronic circuits 206 ("column drivers") associated with the column lines. Drivers 210 and 206 may be implemented for driving the cells of array 208, e.g., by active-matrix addressing, as is known in the art.

According to some demonstrative embodiments of the invention, panel 202 may also include an n-primary-color filter array 216, which may be, for example, juxtaposed to array 208. Panel 202 may include any other suitable configuration of sub-pixel elements.

According to exemplary embodiments of the invention, panel 202 may also include a timing controller (TCON) 218 to receive signals 249 and to adjust the magnitude of a signal 220 delivered to the different column drivers 206 based on the sub-pixel data of signals 249. TCON 118 may also provide drivers 210 with a timing signal 222 to controllably activate rows of LC array 208, e.g., as is known in the art. TCON 218 may include, for example, a standard TCON able to control drivers 210 and/or 220 in accordance with the three-primary sub-pixel configuration of signals 249. The intensity of white light, e.g., provided by a back-illumination source (not shown), may be spatially modulated by LC array 208, selectively attenuating the light for each sub pixel according to the desired intensity of the sub-pixel. The selectively attenuated light passes through MP color filter array 216, wherein each LC cell is in registry with a corresponding color sub-pixel, producing desired color sub-pixel combinations. The human vision system spatially integrates the light filtered through the different color sub-pixels to perceive a color image.

According to some demonstrative embodiments of the invention, array 208 may include a standard TFT backplane, e.g., wherein each square pixel may be represented by three TFT LCD sub-pixels. Thus, each sub-pixel may have an aspect ratio 3:1, e.g., between the width of the sub-pixel and the height of the sub-pixel. Accordingly, array 208 may include 3×N×M, e.g., if the resolution of the panel is M×N pixels in terms of three-primary sub-pixels, where traditionally (but not necessarily) each pixel is divided along video lines, creating 3×M sub-pixels per video line.

According to some demonstrative embodiments of the invention, in order to produce an LCD panel capable of reproducing all the sub-pixels of MP sub-pixel data 239, some considerable modifications may be required compared to a standard RGB LCD panel, for example:

1. Changing the TFT backplane design, to contain more sub-pixels for each pixel of the actual display resolution.
2. Changing the number of data (column) drivers in order to support more sub-pixels per line/column.
3. Additional color filters for the extra primary colors are to be implemented upon the relevant sub-pixels of the panel.

According to some demonstrative embodiments of the invention, it may be desired to avoid one or more of the above modifications, e.g., since they may be relatively complex. Moreover, those adaptations might also affect the price of each panel, due to the additional number of electronic devices and design, thus reducing the cost/effectiveness of the MPC technology in the price-competitive LCD market.

Implementing some demonstrative embodiments of the invention may avoid, for example, the changing of the TFT backplane design, and/or the changing of the number of data (column) drivers. This may be achieved, for example, by system 200 which may include the standard TFT backplane, TCON, and/or drivers, while only the standard RGB filter arrays are replaced with MP filter array 216. This may enable a low-cost solution for MP technology implementation in the LCD market, e.g., while maintaining high quality of color and/or image.

Since array 208 may include only M×3 physical sub-pixels, it looks like the native number of sub-pixels may be reduced by a ratio of $3/N_p$ (where $N_p>3$ is the number of primaries or fundamental colors of the display). More over, each MP pixel group now, containing $N_p$ sub-pixels, lost the 1:1 aspect ratio. It will be understood that the term pixel as used in this application may refer to a grouping of sub-pixels that are formed from a common data set. A pixel group may contain one, more than one, or less than one, sub-pixel of any fundamental color.

A scaling or mapping of M pixels to $M\times3/N_p$ pixels may be performed, for example, before conversion of the three-primary data. Accordingly, each line of M (RGB) pixels may be scaled to $M\times3/N_p$ RGB pixels, which may be converted into $M\times3/N_p$ MP pixels. The $M\times3/N_p$ pixels correspond to $M\times3/N_p\times N_p=M\times3$ sub-pixels, which are the number of physical sub-pixels on the panel. Alternatively, the scaling or mapping may be performed on the MP data, e.g., after the conversion of the three-primary data into the MP data.

It will be appreciated by those skilled in the art, that the scaling/mapping procedures described above may suffer from reduced, e.g., horizontal, resolution compared to the resolution of the input three-primary data. The reduction of resolution may be the result of the following:

1. The reduced number of "native" MP pixels in a line compared to the original pixel resolution;
2. The regular scaling procedure from one resolution to another may suffer from aliasing artifacts.

According to some demonstrative embodiments of the invention, processor 229 may scale the MP sub-pixel data of signals 239, for example, based on knowledge of the arrangement of sub-pixel filter in panel 216; and/or utilizing sub-pixel rendering algorithms, for example, in order to enhance resolution, e.g., in terms of image luminance.

Additionally or alternatively, according to some demonstrative embodiments of the invention processor 229 may utilize characteristics of MP color reproduction, in order to deal with sub-pixel chromaticity fringes, and/or any other phenomena, which may result, for example, from the reduction of resolution for pure color object. Such phenomena may include, for example, aliasing of high-frequency object in pure colors, and/or "mesh effect" reduced uniformity of saturated color areas, due to the reduced density of pure color elements per area.

According to some demonstrative embodiments of the invention, each line of array 204 may include 3×M cells, while each line of multi-primary sub-pixel data 239 may correspond to $N_p \times M$ sub-pixels. Accordingly, the scaling of the data of signals 239 to signals 249 may result in less "full" MP pixels than the original data pixels for each line, e.g., in a factor of 3/k.

According to some demonstrative embodiments of the invention, processor 229 may scale the M multi-primary pixels per line of signals 239, into signals 249 including M×3/k MP sub-pixels per line.

A common method to scale higher resolution data (M>M×3/k), may include re-sampling the data at the position of the new lower resolution pixels, e.g., as is known in the art. Inevitably, since the new sampling rate is lower, the new data has less resolution, and may suffer aliasing.

According to some demonstrative embodiments of the invention, processor 229 may re-sample the data of signals 239 presuming, for each pixel, that the whole data, luminance and/or chromaticity, are given at the center of both the "original pixel" (e.g., the pixel represented by the data of signals 239) and the "new pixel" (e.g., the pixel re-sampled pixel represented by signals 249 corresponding to the original pixel). Thus the resolution of the sampling may be the distance between adjacent pixel centers.

According to some demonstrative embodiments of the invention, re-sampling the original sub-pixel data of signals 239, while considering the centers of the new sub-pixels, may result in the resample rate to be even higher then the original one, thus allowing a better reconstruction of the original resolution. Each sub-pixel may be considered, for example, as lying on the center of a "white" or luminance pixel, e.g., formed by a sequence of three sub-pixels. Accordingly, the luminance of the original image may be reconstructed, and the resolution may be improved, e.g., for objects that contain gray tones and/or non-saturated colors. Thus, according to embodiments of the invention, a data set including a plurality of more than three data points, representing the intensity values of the available colors may be used to represent a data for a pixel group. However, the pixel group may contain less sub-pixels than the number of data points. Various methods are described herein in accordance with the present invention for displaying the data sets having more than three data points to the display having more than three primary or fundamental colors.

According to some demonstrative embodiments of the invention, processor 229 may apply to one or more sub-pixel values of the MP sub-pixel data of signals 239 a suitable convolution function, which may be based for example, on a predetermined set of weights which may be assigned to sub-pixel values of neighboring pixels and/or sub-pixels, e.g., as described below.

Figure 3:
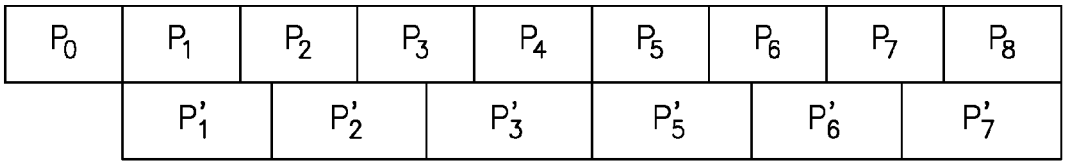
FIG. 3 is a conceptual illustration of re-sampling multi-primary sub-pixel data, in accordance with some demonstrative embodiments of the invention.

Reference is also made to FIG. 3, which conceptually illustrates re-sampling of the MP sub-pixel data of signal 239 (the "MP sub-pixel data") into the sub-pixel data of signal 249 ("the re-sampled data"), in accordance with some demonstrative embodiments of the invention.

According to some demonstrative embodiments of the invention, the MP sub-pixel data of signal 239 may relate to a sequence of pixels, for example, e.g., including nine MP pixels denoted $P_0$, $P_1$, $P_2$, $P_3$, $P_4$, $P_5$, $P_6$, $P_7$, and $P_8$, respectively. Each of the pixels may be represented, for example, by at least four sub-pixel values corresponding to at least four primary colors, respectively. For example, an n-th pixel, $P_n$, may be represented as follows:

$$P_n=[p^0_n, p^1_n, p^2_n, p^3_n] \tag{1}$$

wherein $p^0_n$, $p^1_n$, $p^2_n$, and $p^3_n$ denote sub-pixel values corresponding to four primary colors, respectively.

According to some demonstrative examples of the invention, processor 229 may determine a set of re-sampled MP pixels corresponding to the MP sub-pixel data of signal 239. Processor 229 may be able to re-sample, for example, a sequence of L multi-primary pixels of signal 239 into a sequence M×3/k multi-primary pixels. For example, if signal 239 includes four-primary sub-pixel data, then processor 229 may sample eight MP pixels, e.g., pixels $P_1$, $P_2$, $P_3$, $P_4$, $P_5$, $P_6$, $P_7$, and $P_8$, into a sequence of re-sampled pixels, e.g., including six re-sampled MP pixels denoted $P'_1$, $P'_2$, $P'_3$, $P'_5$, $P'_6$, and $P'_7$, respectively. Each of the re-sampled pixels may be represented, for example, by at least four sub-pixel values corresponding to at least four primary colors, respectively. For example, an n-th re-sampled pixel, $P'_n$, may be represented as follows:

$$P'_n=[p'^0_n, p'^1_n, p'^2_n, p'^3_n] \tag{2}$$

wherein $p'^0_n$, $p'^1_n$, $p'^2_n$, and $p'^3_n$ denote sub-pixel values corresponding to four primary colors, respectively.

According to some demonstrative embodiments of the invention, processor 229 may format the data of the re-sampled pixels in a three-primary configuration, e.g., represented by sets of three sub-pixels values. For example, processor 229 may format the six re-sampled pixels $P'_1$, $P'_2$, $P'_3$, $P'_5$, $P'_6$, and $P'_7$, which may include 24 sub-pixel values, in eight sets of three sub-pixel values, e.g., corresponding to eight pixels of panel 204. Processor 229 may implement any suitable formatting algorithm and/or method.

According to some demonstrative embodiments of the invention, processor 229 may implement any suitable method and/or algorithm to re-sample the MP pixels of signal 239 into the re-sampled MP pixels, e.g., as described below.

According to some demonstrative embodiments of the invention, the luminance resolution may be increased, e.g., beyond that of the original RGB display, for example, using the fact that each MP pixel contains several sub-sets of sub-pixels that can produce white-like combination, given a high enough resolution of the data.

According to some demonstrative embodiments of the invention, processor 229 may apply the following one-dimensional convolution matrix to determine the pixel $P'_n$ based on one or more pixels of the MP sub-pixel data of signal 239:

$$\begin{aligned}[p'^0_n, p'^1_n, p'^2_n, p'^3_n] = {} & W^n_0 \cdot [p^0_{n-1}, p^1_{n-1}, p^2_{n-1}, p^3_{n-1}] + \\ & W^n_1 \cdot [p^0_n, p^1_n, p^2_n, p^3_n] + W^n_2 \cdot [p^0_{n+1}, p^1_{n+1}, p^2_{n+1}, \\ & p^3_{n+1}] + W^n_3 \cdot [p^0_{n+2}, p^1_{n+2}, p^2_{n+2}, p^3_{n+2}]\end{aligned} \tag{3}$$

Equation 3 may be re-written as follows:

$$P'_n = W^n_0 \cdot P_{n-1} + W^n_1 P_n + W^n_2 \cdot P_{n+1} + W^n_3 \cdot P_{n+2} \tag{4}$$

Equation 4 may be re-written as follows:

$$P'_n = \sum_{j=0}^{3} W^n_j \cdot P_{n-1+j} \tag{5}$$

wherein $W^n_j$, wherein j=0 . . . 3, denote a plurality of predetermined weights corresponding to the n-th sub-pixel and to a plurality of the MP pixels $P_{n-1+j}$ of signal 239. For example, processor 229 may determine the values of re-sampled pixel $P'_1$, based on the weight $W^n_0$, representing the pixel $P'_1$ and the neighboring pixel $P_0$; the weight $W^n_1$, representing the pixels $P'_1$ and $P_1$; the weight $W^n_2$, representing the pixel $P'_1$ and the neighboring pixel $P_2$; and the weight $W^n_3$, representing the pixel $P'_1$ and the neighboring pixel $P_3$.

According to some demonstrative embodiments of the invention, processor 229 may apply different weight values $W^n_j$ to the sub-pixel values of signal 239, e.g., according to the primary color corresponding to the sub-pixels. This may be in contrast to conventional re-sampling methods, in which same weights may be applied to all sub-pixels of a sampled pixel. Accordingly, each sub-pixel may have different a weight, e.g., depending also on its position within the pixel. For example, if filter array 216 has a four-primary pixel configuration of RGBY, then the R sub-pixel component of the re-sampled pixel $P'_n$ may be more effected from the R value of the pixel $P_n$, e.g., since the R element is positioned on the left hand side of the pixel $P_n$; while the Y value of re-sampled pixel $P'_n$ may be more effected from the Y value of pixel $P_{n+1}$, since the Y element is positioned on the right hand side of $P_n$.

Thus, according to some demonstrative embodiments of the invention, the convolution matrix implemented by processor 229 to determine the sub-pixel values of re-sampled pixel $P'_n$ may be based on a plurality of weights representing the pixel, one or more neighboring pixels, and/or the color of the sub-pixel. For example, processor 229 may determine the re-sampled pixel $P'_n$ as follows, e.g., if signal 239 include four-primary sub-pixel data:

$$\begin{aligned}[p^0_n, p^1_n, p^2_n, p^3_n] = [&W^n_0\{C(p^0_{n-1})\}\cdot p^0_{n-1}, W^n_0\{C(p^1_{n-1})\}\cdot p^1_{n-1}, W^n_0\{C(p^2_{n-1})\}\cdot p^2_{n-1}, W^n_0\{C(p^3_{n-1})\}p^3_{n-1}] + [W^n_1\{C(p^0_n)\}\cdot p^0_n, W^n_1\{C(p^1_n)\}\cdot p^1_n, W^n_1\{C(p^2_n)\}\cdot p^2_n, W^n_1\{C(p^3_n)\}\cdot p^3_n] + [W^n_2\{C(p^0_{n+1})\}\cdot p^0_{n+1}, W^n_2\{C(p^1_{n+1})\}p^1_{n+1}, W^n_2\{C(p^2_{n+1})\}p^2_{n+1}, W^n_2\{C(p^3_{n+1})\}p^3_{n+1}] + [W^n_3\{C(p^0_{n+2})\}\cdot p^0_{n+2}, W^n_3\{C(p^1_{n+2})\}\cdot p^1_{n+2}, W^n_3\{C(p^2_{n+2})\}\cdot p^2_{n+2}, W^n_3\{C(p^3_{n+2})\}\cdot p^3_{n+2}]\end{aligned} \quad (6)$$

wherein $C(p^0_{n-1})$, $C(p^1_{n-1})$, $C(p^2_{n-1})$, $C(p^3_{n-1})$, $C(p^0_n)$, $C(p^1_n)$, $C(p^2_n)$, $C(p^3_n)$, $C(p^0_{n+1})$, $C(p^1_{n+1})$, $C(p^2_{n+1})$, $C(p^3_{n+1})$, $C(p^0_{n+2})$, $C(p^1_{n+2})$, $C(p^2_{n+2})$, and $C(p^3_{n+2})$ denote the primary colors assigned to sub-pixels $p^0_{n-1}$, $p^1_{n-1}$, $p^2_{n-1}$, $p^3_{n-1}$, $p^0_n$, $p^1_n$, $p^2_n$, $p^3_n$, $p^0_{n+1}$, $p^1_{n+1}$, $P^2_{n+1}$, $p^3_{n+1}$, $p^0_{n+2}$, $p^1_{n+2}$, $p^2_{n+2}$ and $p^3_{n+2}$, respectively; $W^n_0\{C(p^0_{n-1})\}$, $W^n_0\{C(p^1_{n-1})\}$, $W^n_0\{C(p^2_{n-1})\}$, $W^n_0\{C(p^3_{n-1})\}$, denote weights assigned based on the colors $C(p^0_{n-1})$, $C(p^1_{n-1})$, $C(p^2_{n-1})$, and $C(p^3_{n-1})$, respectively, and the pixel $P_0$; $W^n_1\{C(p^0_n)\}$, $W^n_1\{C(p^1_n)\}$, $W^n_1\{C(p^2_n)\}$, and $W^n_1\{C(p^3_n)\}$ denote weights assigned based on the colors $C(p^0_n)$, $C(p^1_n)$, $C(p^2_n)$, and $C(p^3_n)$, respectively, and the pixel $P_1$; $W^n_2\{C(p^0_{n+1})\}$, $W^n_2\{C(p^1_{n+1})\}$, $W^n_2\{C(p^2_{n+1})\}$, $W^n_2\{C(p^3_{n+1})\}$ denote weights assigned based on the colors $C(p^0_{n+1})$, $C(p^1_{n+1})$, $C(p^2_{n+1})$, and $C(p^3_{n+1})$, respectively, and the pixel $P_2$; and $W^n_3\{C(p^0_{n+2})\}$, $W^n_3\{C(p^1_{n+2})\}$, $W^n_3\{C(p^2_{n+2})\}$, and $W^n_3\{C(p^3_{n+2})\}$ denote weights assigned based on the colors $C(p^0_{n+2})$, $C(p^1_{n+2})$, $C(p^2_{n+2})$, and $C(p^3_{n+2})$, respectively, and the pixel $P_3$.

According to other demonstrative embodiments of the invention, processor 229 may apply to the MP sub-pixel data of signals 239 any other suitable convolution function, e.g., a two-dimensional convolution matrix. For example, if filter array 216 includes a staggered configuration of sub-pixels, e.g., wherein odd and even lines include different sub-pixel color sequences, the convolution matrices may be switched between odd and even lines, e.g., to match the different configuration of each line.

According to some exemplary embodiments of the invention, processor 229 may also implement, for example, one or more sub-pixel inter-pixel rendering methods, e.g., as are described below.

In multi-primary displays, there may be some sub-sets of sub-pixels that may be used to create gray and/or non-saturated colors. For example, white may be created using RGB, or using CYR. Other colors using two or three color combinations may be possible. Thus, in order to avoid "mesh" problems on uniform non-saturated areas, methods and systems of the present invention may balance the luminance uniformity over a pixel, by balancing it between two different sub-sets within the pixel.

In some embodiments of the invention, for example, in order to improve uniformity and/or resolution, for saturated color image objects, some of the primary colors may be reconstructed using a combination of other sub-pixels having different colors. For example, yellow may be reproduced using red and green; cyan may be reproduced using green and blue, e.g., as described in International Application PCT/IL2004/001123 filed Dec. 13, 2004 entitled "MULTI-PRIMARY LIQUID CRYSTAL DISPLAY", and published 23 Jun. 2005 as PCT Publication WO 2005/057532, the entire disclosure of which is incorporated herein by reference. Thus, although the "native" MP pixel on is larger than the "native" original pixel, e.g., by a factor of k/3 for k multi-primaries, each MP sub pixel can contain, for example, two different elements for yellow, for example Y and R+G, thereby enhancing the actual yellow resolution. In some embodiments, a color may be unexpressed in a pixel group, in which case the color may be displayed using a combination of sub-pixels that may form the color. For example, in a pixel group that does not contain a Y sub-pixel, intensity values of RG sub-pixels in the pixel group may be calculated to take into consideration not only the red and green data points of the pixel group's data set, but also the yellow data point in the pixel group's data set.

The previous attribute of MP color reproduction may also be also used, additionally or alternatively with the sub-pixel resampling mentioned above, for example, in order to reconstruct high-resolution features and edges. For example, on a five-color RGBYC configuration, if there is a sharp yellow edge originally located at the left-hand side of this MP pixel group, the position of the element may be reconstructed more accurately using the RG pair of sub-pixels, in addition to the Y sub-pixel. This may be useful, for example, in reconstructing elements that exist in graphical contents and PC-generates images, which may be as narrow as one-pixel width element.

High frequency graphical elements, like computer-generated presentations, can also use a special preset, that can be a little less saturated, thus allowing more-then-one participating sub-pixels per pixel, that along with the sub-pixel resampling will allow better perceived resolution, and avoid "mesh" effects.

For graphical elements, some compensation algorithm as discussed above within the pixel, might also take into account the spatial data of nearby pixels and of other primaries data, in order to choose which kind of inter-pixel sub pixel compensation should be used, e.g., as described in the above-referenced documents.

Inter-pixel sub-pixel rendering may be used, for example, in order to reduce and/or correct chromaticity fringes that may arise from the sub-sampling process. This rendering may include one, some or all of the following methods: a running average in the sub-pixel level; using different sub-sets within the pixel group in order to correct for position in accuracies; using spatial filters and data of adjacent or nearby pixel groups in order to calculate inter-pixel compensation.

Embodiments of the present invention may be implemented by software, by hardware, or by any combination of software and/or hardware as may be suitable for specific applications or in accordance with specific design requirements. Embodiments of the present invention may include units and sub-units, which may be separate of each other or combined together, in whole or in part, and may be implemented using specific, multi-purpose or general processors, or devices as are known in the art. Some embodiments of the present invention may include buffers, registers, storage units and/or memory units, for temporary or long-term storage of data and/or in order to facilitate the operation of a specific embodiment.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

We claim:

1. A method of displaying an image on a color display comprising a liquid crystal (LC) array having a plurality of sub-pixels, the color display further comprising a plurality of color filters including a number N of different non-white colors, wherein N is greater than three, each of said sub-pixels of the LC array being aligned with a corresponding color filter, the method comprising:

receiving a plurality of three-color data sets, each including exactly three data points;

converting the three-color data sets using a conversion algorithm to obtain a respective plurality of multiprimary pixel data sets, each having N data points;

associating said multiprimary pixel data sets with respective pixel groups in the display, each pixel group comprising exactly three adjacent sub-pixels; and for at least one sub-pixel in each said pixel group, providing an intensity value for the sub-pixel based at least on a first data point in the corresponding multiprimary pixel data set corresponding to the color of the filter aligned with said sub-pixel, and a second data point included in a multiprimary data set associated with an adjacent pixel group corresponding to the color of the filter aligned with the sub-pixel and corresponding to a color not present among the filters aligned with sub-pixels in the adjacent pixel group.

2. The method of claim 1, wherein said providing an intensity value is further based on a third data point, said third data point being an intensity value in the multiprimary pixel data set corresponding to a color not represented in the corresponding pixel group.

3. A color display system comprising:

a display comprising a liquid crystal (LC) array having a plurality of sub-pixels, the color display further comprising a plurality of color filters including a number N of different non-white colors, wherein N is greater than three, each said sub-pixel of the LC array being aligned with a corresponding color filter, none of said colors being white;

a data converter to convert a plurality of first data sets having exactly three data points to a respective plurality of second data sets having N data points and corresponding to respective pixel groups, each pixel group comprising exactly three adjacent sub-pixels; and a scaling processor to calculate for at least one sub-pixel in each said pixel group an intensity value based at least on a first data point in a first one of said second data sets corresponding to the color of said sub-pixel and a second data point in a second one of said second data sets associated with an adjacent pixel group, said second data point corresponding to the color of said sub-pixel, wherein said different color is not among the filters aligned with any of the sub-pixels in the adjacent pixel group.

4. The system of claim 3, further comprising a timing controller to provide said intensity values to sub-pixels.

5. The system of claim 3, wherein said liquid crystal elements are controlled by thin film transistors.

6. The color display system of claim 3, wherein said scaling processor is to calculate said intensity value based on a third data point, said third data point being an intensity value in the first one of said second data sets corresponding to a color not represented in the corresponding pixel group.

* * * * *